US007112394B2

(12) United States Patent
Smith

(10) Patent No.: US 7,112,394 B2
(45) Date of Patent: Sep. 26, 2006

(54) THERMOSETTING TONER COMPOSITIONS, THERMOSETTING DEVELOPER COMPOSITIONS AND METHODS FOR MAKING AND USING THE SAME

(75) Inventor: Thomas W. Smith, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 237 days.

(21) Appl. No.: 10/788,445

(22) Filed: Mar. 1, 2004

(65) Prior Publication Data

US 2005/0191573 A1 Sep. 1, 2005

(51) Int. Cl.
*G03G 9/087* (2006.01)

(52) U.S. Cl. ..... 430/109.1; 430/109.2; 430/109.3; 430/109.4; 430/137.1

(58) Field of Classification Search ..... 430/109.2, 430/109.1, 109.3, 109.4, 137.1
See application file for complete search history.

(56) References Cited

U.S. PATENT DOCUMENTS

| | | | | |
|---|---|---|---|---|
| 3,944,493 | A | 3/1976 | Jadwin et al. | |
| 4,007,293 | A | 2/1977 | Mincer et al. | |
| 4,079,014 | A | 3/1978 | Burness et al. | |
| 4,217,406 | A * | 8/1980 | Tanaka et al. | 430/137.15 |
| 4,265,990 | A | 5/1981 | Stolka et al. | |
| 4,394,430 | A | 7/1983 | Jadwin et al. | |
| 4,557,991 | A * | 12/1985 | Takagiwa et al. | 430/108.8 |
| 4,560,635 | A | 12/1985 | Hoffend et al. | |
| 4,563,408 | A | 1/1986 | Lin et al. | |
| 4,584,253 | A | 4/1986 | Lin et al. | |
| 4,585,884 | A | 4/1986 | Lin et al. | |
| 4,883,736 | A | 11/1989 | Hoffend et al. | |
| 4,935,326 | A | 6/1990 | Creatura et al. | |
| 4,937,166 | A | 6/1990 | Creatura et al. | |
| 5,492,787 | A * | 2/1996 | Matsunaga et al. | 430/109.2 |
| 6,004,714 | A | 12/1999 | Ciccarelli et al. | |
| 6,017,668 | A | 1/2000 | Young et al. | |
| 6,071,665 | A | 6/2000 | Dickerson et al. | |
| 6,087,059 | A | 7/2000 | Duggan et al. | |
| 6,103,440 | A | 8/2000 | Lohr | |
| 6,124,071 | A | 9/2000 | Lin et al. | |
| 6,197,883 | B1 | 3/2001 | Schimmel et al. | |
| 6,218,483 | B1 | 4/2001 | Muthiah et al. | |
| 6,228,941 | B1 | 5/2001 | De Cock et al. | |
| 6,309,787 | B1 | 10/2001 | Cheng | |
| 2004/0058266 | A1 * | 3/2004 | Matsumura et al. | 430/109.2 |

FOREIGN PATENT DOCUMENTS

| | | |
|---|---|---|
| DE | 198 04 281 A1 | 8/1999 |
| EP | 1 055 694 A2 | 11/2000 |
| EP | 1 111 012 A1 | 6/2001 |
| GB | 1 442 835 | 7/1976 |
| JP | 60 004946 | 1/1985 |
| JP | 01 038757 | 2/1989 |
| JP | 64-038757 | 2/1989 |
| JP | 03 135578 | 6/1991 |
| JP | 06 258869 | 9/1994 |
| JP | 08 211646 | 8/1996 |
| JP | A 2000-160061 | 6/2000 |
| JP | A 2001-123110 | 5/2001 |
| WO | WO 94/10221 | 5/1994 |

* cited by examiner

*Primary Examiner*—John L Goodrow
(74) *Attorney, Agent, or Firm*—Oliff & Berridge PLC

(57) ABSTRACT

A toner composition includes a thermoset resin, cross-linking agent, and optionally additives such as colorants. The thermally cross-linkable toner composition may be fixed, using standard fusing systems, to yield images that withstand rigorous processing conditions, such as, for example, the high temperatures reached in flexible packaging processes.

13 Claims, No Drawings

THERMOSETTING TONER COMPOSITIONS, THERMOSETTING DEVELOPER COMPOSITIONS AND METHODS FOR MAKING AND USING THE SAME

BACKGROUND OF THE INVENTION

1. Field of Invention

This invention relates to thermosetting toner and developer compositions and methods by which such thermosetting toner and developer compositions can be prepared and used.

2. Description of Related Art

Conventional toner and developer compositions for xerographic systems are prepared from thermoplastic resins. The molecular weight and structural characteristics, such as the degree of polymerization, polydispersity, segment distribution and branching, of conventional toner and developer compositions have been tuned to optimize fusing requirements and image characteristics. Conventional toner and developer compositions include thermoplastic resins, such as styrene-acrylic or polyester resins, and combinations of one or more pigments, charge control agents, release agents, and other additives, compounded together to yield toner and developer compositions. By selecting various homopolymers and copolymers, conventional toner and developer compositions possessing specific chemical, mechanical and/or triboelectric properties have been prepared.

Numerous processes are known for the preparation of conventional toner and developer compositions. For example, in conventional processes, a resin is melt-kneaded or extruded with a colorant, particularly a pigment, and the product thereof is micronized and pulverized to provide toner particles.

In recent years, greater flexibility in the selection of resin materials and the elimination of attrition and classification steps has been realized thorough the "chemical" fabrication of toners by the controlled, heteroaggregation and accretion of sub-micron resin emulsions and pigment dispersions to directly yield particulate toner compositions. There are several so-called chemical processes for making conventional toner compositions. In aggregation/coalescence processes for making toner particles, such as those described in U.S. Pat. No. 6,309,787, the resin is prepared as a water-based dispersion of sub-micron-sized polymer particles (polymeric latex), which are then aggregated with pigment particles of sub-micron size to the desired toner size and are then coalesced to produce pigmented toner particles. The entire disclosure of U.S. Pat. No. 6,309,787 is incorporated herein by reference.

SUMMARY OF THE INVENTION

Despite the broad range of toner and developer compositions available, the above-mentioned conventional toner and developer compositions are deficient in several ways. For example, traditional thermoplastic toner compositions cannot withstand the rigorous processing conditions of flexible packaging materials where the packaging materials are printed with the toner compositions prior to further processing of the packaging materials. For example, xerographic images printed with conventional, thermoplastic toners, such as those described above, do not possess sufficient heat and pressure-resistance to allow them to withstand the processing conditions imposed on flexible packaging materials after they are printed. The pile height of conventional color xerographic images is also problematic.

In order to prevent melting of conventional toner images during processing of flexible packaging, over-lacquers have been designed and applied to conventional xerographic images. Applying the over-lacquers create an added burden on high-speed xerographic printing, with post-fusing processing steps that add significant cost and complexity to the process.

The present invention addresses these problems by using thermally cross-linkable polymer resins to provide thermosetting toner and developer compositions. The use of thermally cross-linkable polymer resins provides significant benefits over conventional toner and developer compositions. Thermosetting polymer resins undergo reactions on heating to form a solid, highly cross-linked matrix. Thermosetting polymer resins cannot be re-formed into a different shape by reheating, unlike thermoplastic polymer resins such as those used in conventional toner compositions. Thus, thermosetting toner compositions retain their fused form, even under rigorous processing conditions.

In particular, the present invention provides a toner composition including at least one thermosetting polymer resin, and optionally, at least one additive.

The present invention also provides developers comprising such a toner composition, methods for making such a toner composition, and methods for using such a toner composition.

DETAILED DESCRIPTION OF PREFERRED EMBODIMENTS

In various exemplary embodiments of the present invention, materials employed in the coatings industry for electrostatic powder coatings are adapted to create thermally cross-linkable toner compositions. In various exemplary embodiments of the invention, thermosetting toners are fixed, using standard fusing systems, to yield images that will withstand the high temperatures reached in the flexible packaging process.

Various exemplary embodiments of the present invention provide thermally cross-linkable polymer resins in thermosetting toner and developer compositions. Thermally cross-linkable polymer resins provide significant benefits to the toner compositions. The thermosetting polymer resins undergo reactions on heating to form a solid, highly cross-linked matrix. Thermosetting polymer resins cannot be re-formed into a different shape by reheating, unlike thermoplastic polymer resins such as those used in traditional toner compositions. Thus, thermosetting resins yield toner and developer compositions that, once fused to a substrate, can withstand rigorous conditions, including high heat and pressure, without deforming or melting.

In various exemplary embodiments of the invention, thermosetting toner compositions are prepared using suitable thermosetting polymer resins. In addition, in various exemplary embodiments of the invention, thermosetting toner compositions are formulated by adapting known powder-coating compositions. In various exemplary embodiments of the invention, suitable thermosetting toner compositions are adapted from systems such as, for example: carboxyl-terminated branched polyesters in combination with multifunctional epoxy resins, such as those described in U.S. Pat. No. 6,228,941; carboxyl-functionalized acrylic resins compounded with multifunctional epoxy resins, such as those described in Japanese patent application publication JP 2001-123110; epoxy resins or epoxy-functionalized acrylic resins in combination with latent polyfunctional amine catalysts, such as those described in U.S. Pat. No.

6,197,883 and European Patent EP 1 055 694 A2; blocked isocyanates in combination with hydroxyl-functionalized polyesters or acrylics, such as those described in WO 94/10221, Japanese patent application publication JP 2000-160061 and German Patent DE 198 04 281 A1; epoxy functionalized resins in combination with polycarboxylic acid cross-linking agents, such as those described in U.S. Pat. No. 6,218,483; macrocyclic esters, carbonates, amides or imides, ring opened and polymerized in the present of polyfunctional epoxy resins, such as those described in European Patent EP 1 111 012 A1; mixtures thereof, and the like. The entire disclosures of the above-cited references are incorporated herein by reference.

In various exemplary embodiments of the invention, thermally cross-linkable resins such as carboxyl- and hydroxyl-functionalized polyester and acrylic resins, epoxy resins and epoxy-functionalized acrylic resins, blocked isocyanates, hydroxyl-functionalized polyesters or acrylics, polycarboxylic acid cross-linking agents, macrocyclic esters, carbonates, amides or imides and polyfunctional epoxy resins, which can be obtained commercially, are used. In various exemplary embodiments of the invention, commercially available polyfunctional amine catalysts are used.

The toner resin is generally present in any sufficient, but effective amount. In various exemplary embodiments of the invention, a toner resin is present in an amount of from about 50 to about 95 percent by weight of a toner composition. In various exemplary embodiments of the invention, the toner resin is present in an amount of from about 70 to about 90 percent by weight of the toner composition.

In various exemplary embodiments of the invention, in the preparation of powder coating composites, mixtures of these kind have typically been extrusion processed and attrited. Further, in various exemplary embodiments of the invention, conventional melt processing/attrition and chemical toner fabrication processes are employed to adapt such systems to produce thermosetting toner compositions. However, the formulation window for creation of a composition that does not cross-link during melt-compounding but cross-links rapidly after application to the desired substrate is narrow for xerographic applications, where the toner must be rapidly fused onto paper or other thermally sensitive substrates.

In various exemplary embodiments of the invention, mixtures of separate toner compositions are used, in which reactive functionalities are isolated in separate particles. In various exemplary embodiments of the invention, toner compositions are dry-blended to form a mixed-particle toner composition. When particles of toner compositions of exemplary embodiments melt together during fusing, the reactive functionalities interact to cross-link the resins. An advantage of such a process is that individual functional resin components can be easily melt-compounded without the possibility of cross-linking during the compounding of the toner compositions. Controlling gel time as a developed image moves through a fuser is also advantageous. In various exemplary embodiments, where high gloss is desired, toner compositions can be formulated free of pigment.

Chemical toner preparation process is unique in that it allows for low temperature heterocoagulation of carboxyl-terminated polyester or acrylic emulsions with epoxy-functionalized resin emulsions and pigment dispersions to directly yield toner particles. Accordingly, in various exemplary embodiments of the invention, low-temperature fusing and cross-linking requirements imposed by thermally sensitive substrates are accommodated.

Synthesized acrylic and methacrylic acid-containing acrylic emulsions, glycidyl methacrylate functional acrylic emulsions, carboxylic acid-terminated dissipatible polyester emulsions and commercial epoxy resin emulsions provide materials for fabrication of various exemplary embodiments by chemical toner preparation processes.

In various exemplary embodiments of this invention, additives are incorporated. Additives may be added, in various exemplary embodiments, for any of various reasons, including, but not limited to, providing improved charging characteristics and improving flow properties. For example, additives including, but not limited to, colorants, flocculates, fillers, optional charge enhancing additives and optional waxes are known to be useful in toner compositions.

Toner compositions of various exemplary embodiments of the present invention include one or more conventional additives, including but not limited to, surface additives, colorants, flocculates, surfactants, fillers, optional charge enhancing additives and waxes. Thermosetting toner compositions of various exemplary embodiments of the present invention can be produced by modifying toner compositions such as those described above and including but not limited to those toner compositions disclosed in, for example, U.S. Pat. Nos. 6,004,714, 6,017,668, 6,071,665, 6,087,059, 6,103,440, and 6,124,071, the entire disclosures of which are incorporated herein by reference.

Toner compositions of the various exemplary embodiments of the present invention are prepared by any known technique, such as by admixing and heating resin particles, colorant, and additives, in a suitable toner extrusion device, such as the ZSK53 available from Werner Pfleiderer, followed by removing formed toner composition from the device. After cooling, toner compositions of various exemplary embodiments of the present invention are subjected to grinding utilizing, for example, a Sturtevant micronizer to achieve toner particles with a volume median diameter of less than about 25 microns. In various exemplary embodiments, toner particles have a volume mean diameter from about 6 to about 12 microns. Volume mean diameters are determined by a particle sizing apparatus using the Coulter principle, such as a COULTER COUNTER™. Subsequently, toner compositions of various exemplary embodiments of the present invention can be classified utilizing, for example, a Donaldson Model B classifier, to remove fines, or toner particles having a volume median diameter of less than about 4 microns. Thereafter, in various exemplary embodiments of the invention, optional surface additives can be added to toner composition by blending the additives with the obtained toner particles.

In various exemplary embodiments of the present invention, the thermosetting toner composition comprises, in particular, a carboxylic acid-terminated polymer or oligomer, typified by a carboxyl-terminated branched polyester, and multifunctional epoxy resins compounded with suitable colorants, charge control agents, flow aids and release agents. In these embodiments, the thermal reaction between the carboxylic acid and epoxy-functional groups is leveraged to cross-link the resin system. Similarly, carboxyl-functionalized acrylic resins can be compounded with multifunctional epoxy resins.

Colorants incorporated into various exemplary embodiments of the invention include pigments, dyes, and mixtures of pigments with dyes, and the like. For example, various known cyan, magenta, yellow, red, green, brown, or blue colorants, or mixtures thereof are incorporated into thermosetting toner compositions of various exemplary embodiments of the invention. In various exemplary embodiments of the invention, cyan, magenta, or yellow pigments or dyes, or mixtures thereof, are used. The pigment or pigments can be used as water based pigment dispersions in various exemplary embodiments of the invention.

Illustrative examples of colorants, such as pigments, that may be used in the processes of various exemplary embodiments of the present invention include, but are not limited to, carbon black, such as REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™;Northern Pigments magnetites, NP-604™, NP-608™; Magnox magnetites TMB-100™, or TMB-104™; and the like. Colored pigments or dyes, including cyan, magenta, yellow, red, green, brown, blue and/or mixtures thereof, may also be used.

Specific examples of pigments added in various exemplary embodiments of the invention, include, but are not limited to, SUNSPERSE 6000™, FLEXIVERSE™ and AQUATONE™ water-based pigment dispersions from SUN Chemicals, phthalocyanine HELIOGEN BLUE L6900™, D6840™, D7080™, D7020™, PYLAM OIL BLUE™, PYLAM OIL YELLOW™, PIGMENT BLUE 1™, available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTATA™ available from E.I. DuPont de Nemours & Company, Pigment Yellow 180, Pigment Yellow 12, Pigment Yellow 13, Pigment Yellow 14, Pigment Yellow 17, Pigment Blue 15, Pigment Blue 15:3, Pigment Red 122, Pigment Red 57:1, Pigment Red 81:1, Pigment Red 81:2, Pigment Red 81:3, and the like. Examples of magentas include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments in the processes of the present invention.

In various exemplary embodiments of the invention, a colorant is included in a toner composition in known amounts, to achieve a desired color strength. For example, in various exemplary embodiments of the invention, at least one of the above-described dyes and/or pigments, and/or other colorants, is included in a toner composition in a suitable amount. In various exemplary embodiments, at least one of the above-described dyes and/or pigments, and/or other colorants, is included in an amount from about 1 to about 20 percent by weight of the toner composition. In various exemplary embodiments, the colorant is included in an amount of from about 2 to about 10 percent by weight of the toner composition.

In various exemplary embodiments of the invention, magnetites are included in the toner composition, either for their magnetic properties, or for the colorant properties, or both. Magnetites that are used in toner compositions of various exemplary embodiments of the present invention include, but are not limited to, a mixture of iron oxides ($FeO.Fe_2O_3$), including those commercially available as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600 ™, 8610™; Northern Pigments magnetites, NP-604™, NP-608™; Magnox magnetites TMB-100™, or TMB-104™; and the like. In various exemplary embodiments of the invention, a magnetite is present in a toner composition in an effective amount. In various exemplary embodiments, the magnetite is present in an amount of from about 10 percent by weight to about 75 percent by weight of the toner composition. In various exemplary embodiments, the magnetite is present in an amount of from about 30 percent to about 55 percent by weight of the toner composition.

In various exemplary embodiments of the invention, flocculates are included in a toner composition in an effective amount. In various exemplary embodiments, the flocculates are included in the toner composition in an amount from about 0.01 percent to about 10 percent by weight of the toner. Flocculates used in various exemplary embodiments of the invention include, but are not limited to, polyaluminum chloride (PAC), dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like.

In various exemplary embodiments of the invention, at least one charge additive is used in suitable effective amounts. In various exemplary embodiments, the at least one charge additive is used in amounts from about 0.1 to about 15 percent by weight of the toner composition. In various exemplary embodiments of the invention, the at least one charge additive is used in amounts from about 1 to about 15 percent by weight of the toner composition. In various exemplary embodiments of the invention, the at least one charge additive is used in amounts from about 1 to about 3 percent by weight of the toner composition. Suitable charge additives in various exemplary embodiments of the invention include, but are not limited to, alkyl pyridinium halides, bisulfates, the charge control additives of U.S. Pat. Nos. 3,944,493; 4,007,293; 4,079,014; 4,394,430 and 4,560,635 (which illustrate a toner with a distearyl dimethyl ammonium methyl sulfate charge additive, the entire disclosures of which are hereby incorporated by reference), negative charge enhancing additives, such as, for example, aluminum complexes, and other charge additives known in the art or later discovered or developed.

In various exemplary embodiments of the invention, at least one wax is present in a toner composition, for the known effects of waxes, such as, for example, as fusion roll release agents. In various exemplary embodiments of the invention, at least one wax is present in a toner composition in an amount of from about 1 percent by weight to about 15 percent by weight, based on the weight of the toner composition. In various exemplary embodiments, the wax is present in the toner composition in an amount of from about 2 percent by weight to about 10 percent by weight, based on the weight of the toner composition for the known effect of waxes such as fuser roll release agents. Toner compositions of various exemplary embodiments of the present invention include waxes with a molecular weight (Mw) of from about 1,000 to about 20,000, such as polyethylene, polypropylene, and paraffin waxes. In various exemplary embodiments of the invention, the at least one wax includes, but is not limited to, polypropylenes and polyethylenes commercially available from Allied Chemical and Petrolite Corporation; Epolene N-15 commercially available from Eastman Chemical Products, Inc.; Viscol 550-P, a low weight average molecular weight polypropylene available from Sanyo Kasei K.K.; mixtures thereof, and the like. Commercially available polyethylenes, selected in various exemplary embodiments of the invention, possess a weight average molecular weight of from about 1,000 to about 1,500. Commercially available polypropylenes utilized in various exemplary embodiments of the invention have a weight average molecular weight of from about 4,000 to about 7,000. Polyethylene and polypropylene compositions useful in various embodiments of the invention are illustrated in British Patent 1,442,835, the entire disclosure of which is incorporated herein by reference.

The powder compositions of the present invention may also include fillers, such as, for example, quartz; silicates; aluminosilicates; corundum; ceramic fillers; glass; carbonates, such as chalk, kaolin; inorganic fibers and the like; calcium sulfate; barium sulfate; magnesium sulfate; and any other known or later developed filler materials, and are included in amounts suitable to adjust the rheological characteristics of the powder composition.

Toner compositions of various exemplary embodiments of the present invention may contain polymeric alcohols, such as, for example, UNILINS™ and those disclosed in U.S. Pat. No. 4,883,736, the entire disclosure of which is incorporated herein by reference. The UNILINS™ products are available from Petrolite Corporation.

In various exemplary embodiments of the invention, developer compositions are prepared by mixing toners with carrier particles. In various exemplary embodiments of the invention, a toner composition is mixed with carrier particles so that a developer composition having a concentration of from about 2 to about 8 percent toner particles concentration results. In various exemplary embodiments of the invention, carrier particles include at least one coating thereon, such as, for example, those illustrated in U.S. Pat. Nos. 4,937,166 and 4,935,326. In various exemplary embodiments of the invention, a single coating polymer, or a mixture of polymers are used as a coating. Specific examples of coatings in various exemplary embodiments of the invention, are fluorocarbon polymers, acrylate polymers, methacrylate polymers, silicone polymers, and the like. In various exemplary embodiments of the invention, at least one polymer coating contains at least one conductive component in an effective amount. In various exemplary embodiments of the invention, at least one polymer coating contains at least one conductive component of from about 10 to about 70 weight percent. In various exemplary embodiments of the invention, at least one polymer coating contains at least one conductive component from about 20 to about 50 weight percent. In various exemplary embodiments, the conductive component is carbon black.

Various exemplary embodiments of the invention include imaging methods including toners of the present invention. In various exemplary embodiments, imaging methods utilizing toner particles, are adapted from, for example, the various patents mentioned herein as well as U.S. Pat. Nos. 4,585,884, 4,584,253, 4,563,408, and 4,265,990, the entire disclosures of which are incorporated herein by reference.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLE

Cyan Thermoset Chemical Toner with Carboxyl-Functionalized Acrylic Resin and Multi-Functional Epoxy Resin Powder particles comprising styrene/ethylacrylate/acrylic acid-based resin, glycidyl methacrylate/styrene/methylmethacrylate/isobutylmethacrylate/2-hydroxyethylmethacrylate-based resin and cyan Pigment Blue 15.3 pigment (available from Sun Chemicals) were prepared as follows:

(i) A latex emulsion comprised of polymer particles, generated from the emulsion polymerization of styrene, ethyl acrylate and acrylic acid and polymer particles, generated from the emulsion polymerization of glycidyl methacrylate, styrene, methylmethacrylate, isobutylmethacrylate and 2-hydroxyethylmethacrylate, was prepared as follows:

Separately, polymer emulsions are prepared in the following manner:

(a) 216 kilograms of styrene, 122.4 kilograms of ethyl acrylate and 21.6 kilograms of acrylic acid, 6 kilograms of 1-dodecanethiol, 3 kilograms of dodecanediol diacrylate (ADOD), 8.05 kilograms of DOWFAX™ (anionic surfactant), and 216 kilograms of deionized water are mixed for 10 minutes in a stainless steel holding tank. The holding tank was then purged with nitrogen for 5 minutes before transferring the mixture into a reactor. The reactor is then continuously purged with nitrogen while the mixture was stirred at 100 rpm (revolutions per minute). The reactor is then heated up to 80° C. Separately, 6.8 kilograms of ammonium persulfate initiator are dissolved in 33.55 kilograms of deionized water. The initiator solution is then slowly charged into the reactor and after 10 minutes the rest of the emulsion is continuously fed into the reactor using metering pumps. Once all of the emulsion is charged into the main reactor, the temperature is held at 80° C. for an additional 2 hours to complete the reaction. Full cooling is then applied and the reactor temperature is reduced to 35° C. The product, a carboxylated latex emulsion comprised of styrene/ethylacrylate/ acrylic acid (60/34/6 proportionately by weight), containing 40% solids and having an average particle size of about 200 nm, Mw about 30,000 and Tg mid-point about 53° C., is collected into a holding tank.

(b) 324 kilograms of glycidyl methacrylate, 144 kilograms of styrene, 144 kilograms of methylmethacrylate, 72 kilograms of isobutylmethacrylate and 36 kilograms of 2-hydroxyethylmethacrylate, 6 kilograms of 1-dodecanethiol, 3 kilograms of ADOD, 8.05 kilograms of DOWFAX™, and 216 kilograms are mixed for 10 minutes in a stainless steel holding tank. The holding tank was then purged with nitrogen for 5 minutes before transferring the mixture into a reactor. The reactor is then continuously purged with nitrogen while the mixture was stirred at 100 rpm (revolutions per minute). The reactor is then heated up to 80° C. Separately, 6.8 kilograms of ammonium persulfate initiator are dissolved in 33.55 kilograms of deionized water. The initiator solution is then slowly charged into the reactor and after 10 minutes the rest of the emulsion is continuously fed into the reactor using metering pumps. Once all of the emulsion is charged into the main reactor, the temperature is held at 80° C. for an additional 2 hours to complete the reaction. Full cooling is then applied and the reactor temperature is reduced to 35° C. The product, a 30% solids epoxy-containing acrylic emulsion comprising glycidyl methacrylate/styrene/methylmethacrylate/isobutylmethacrylate/2-hydroxyethylmethacrylate (45/20/20/10/5 proportionately by weight), is collected into a holding tank.

123 g of the carboxylated latex comprised of styrene/ethylacrylate/acrylic acid (a) is mixed with 62 g of the epoxy-containing acrylic emulsion (b) as prepared above.

(ii) Preparation of Cyan Powder Composition 185 grams of the above prepared mixed emulsion, an aqueous cyan pigment dispersion containing 60 grams of blue pigment Pigment Blue 15.3 (available from Sun Chemicals), having a solids loading of 35.5 percent, and 2.5 g of SANIZOL B-50™, are simultaneously added to 640 milliliters of water at room temperature, about 25° C., while being mixed at a shear speed of 7,000 rpm by means of a polytron for about 5 minutes. 26 grams of a polyaluminum chloride (PAC) solution containing 2.6 grams of 10 percent solids and 23.4 grams of 0.2 molar nitric acid are added to this mixture, over a period of 2 minutes, and are blended at speed of 5,000 rpm for a period of 2 minutes. The resulting mixture, which has a pH of about 2.7; is then transferred to a 2-liter reaction vessel and heated at a temperature of 58° C. for 60 minutes, resulting in aggregates of a size 6.5 and the GSD was 1.19. 28 ml of aqueous BIOSOFT d40™ solution (sodium dodecylbenzene sulfonate, available from Stepan Chemical) is added to the resulting mixture followed by adjusting the pH from about 2.7 to about 7.9 and with aqueous base solution of 4 percent sodium hydroxide, and this mixture is allowed to stir for an additional 15 minutes. Subsequently, the resulting mixture is heated to 93° C. and retained there for a period of 1 hour. The pH of the resultant mixture is then lowered from about 7.6 to about 2.6 with 5 percent nitric acid. After 4 hours (total) at a temperature of 93° C., the particles are in the shape of spheres when observed under the optical microscope, and have a size of about 6.5 microns with a GSD of about 1.18. The reactor is then cooled to room temperature and the particles are washed 4 times, where the first wash is conducted at a pH of 11, followed by 2 washes with deionized water, and a final wash accomplish at a pH of 2. The particles are then dried on a freeze dryer.

While this invention has been described in conjunction with the exemplary embodiments outlined above, various alternatives, modifications, variations, improvements, and/or substantial equivalents, whether known or that are, or may be, presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the systems, methods and devices according to this invention are intended to embrace all known or later-developed alternatives, modifications, variations, improvements, and/or substantial equivalents.

What is claimed is:

1. A toner composition comprising at least one thermally cross-linkable polymer resin and at least one cross-linking agent, wherein:

the at least one thermally cross-linkable polymer resin is at least one thermosetting polymer resin selected from the group consisting of carboxylic acid-terminated polymers and oligomers; epoxy resins; blocked isocyanates; macrocyclic esters; carbonates; amides; and imides; and the at least one cross-linking agent is at least one member selected from the group consisting of polyfunctional amine catalysts.

2. The toner composition according to claim 1, further comprising at least one additional polymer selected from the group consisting of hydroxyl-functionalized polyesters and acrylics, and wherein the at least one thermally cross-linkable polymer resin is at least one thermosetting polymer resin selected from the group consisting of blocked isocyanates.

3. The toner composition according to claim 1, wherein the at least one thermally cross-linkable polymer resin is at least one thermosetting polymer resin selected from the group consisting of epoxy resins.

4. The toner composition according to claim 1, wherein the at least one thermally cross-linkable polymer resin is at least one thermosetting polymer resin selected from the group consisting of macrocyclic esters, carbonates, and imides and wherein the at least one thermally cross-linkable polymer resin is ring-opened and polymerized in the presence of polyfunctional epoxy resins.

5. The toner composition according to claim 1, further comprising at least one additive, wherein the at least one additive is at least one member selected from the group consisting of colorants, magnetites, flocculates, charge enhancing additives, surface additives, and waxes.

6. The toner composition according to claim 5, wherein the at least one colorant is at least one member selected from the group consisting of pigments, dyes and mixtures of pigments with dyes.

7. The toner composition according to claim 1, comprising a dry-blended composition comprising at least a first component and a second component, wherein the at least one thermally cross-linkable polymer resin forms the first component and the at least one cross-linking agent forms the second component.

8. A developer composition comprising a carrier particle and the toner composition according to claim 1.

9. A process for the preparation of a toner composition comprising combining at least one thermally cross-linkable polymer resin and at least one cross-linking agent, wherein:

the at least one thermally cross-linkable polymer resin is at least one thermosetting polymer resin selected from the group consisting of carboxylic acid-terminated polymers and oligomers; epoxy resins; blocked isocyanates; macrocyclic esters; carbonates; amides; and imides; and the at least one cross-linking agent is at least one member selected from the group consisting of polyfunctional amine catalysts.

10. The process according to claim 9, wherein combining at least one thermally cross-linkable polymer resin and at least one cross-linking agent comprises melt processing and attrition.

11. The process according to claim 9, wherein combining at least one thermally cross-linkable polymer resin and at least one cross-linking agent comprises a chemical preparation process.

12. A method of imaging comprising developing an image with the toner composition of claim 1.

13. An imaging apparatus containing the toner composition of claim 1.

* * * * *